United States Patent [19]

Powell

[11] 4,240,050

[45] Dec. 16, 1980

[54] TWO STUB TUNER IN WAVEGUIDE BEND

[75] Inventor: Robert C. Powell, Gaithersburg, Md.

[73] Assignee: Weinschel Engineering Co., Inc., Gaithersburg, Md.

[21] Appl. No.: 53,343

[22] Filed: Jun. 29, 1979

[51] Int. Cl.[3] ..... H01P 1/02

[52] U.S. Cl. ..... 333/33; 333/249; 333/253

[58] Field of Search ..... 333/33, 249, 253

[56] References Cited

U.S. PATENT DOCUMENTS

| | | | |
|---|---|---|---|
| 2,737,634 | 3/1956 | Lewin et al. | 333/249 |
| 2,810,111 | 10/1957 | Cohn | 333/249 |
| 2,993,140 | 7/1961 | Westbrook | 333/249 X |

*Primary Examiner*—Paul L. Gensler
*Attorney, Agent, or Firm*—Howard L. Rose

[57] ABSTRACT

In order to cancel unwanted reflected waves in a waveguide system, two micrometer-driven stub tuners are inserted in a waveguide bend. A first tuner is inserted through the outer bend wall to extend axially along one leg of the bend and includes a dielectric rod having a reflecting slug at its tip. Axial movement of the rod permits the variable position of the slug to vary the phase of the wave which it reflects. The second tuner includes a metal rod, which enters the waveguide transversely from the inner wall of the bend, diametrically across from the entrance of the dielectric rod, and permits adjustment of the magnitude of the wave which it reflects.

9 Claims, 1 Drawing Figure

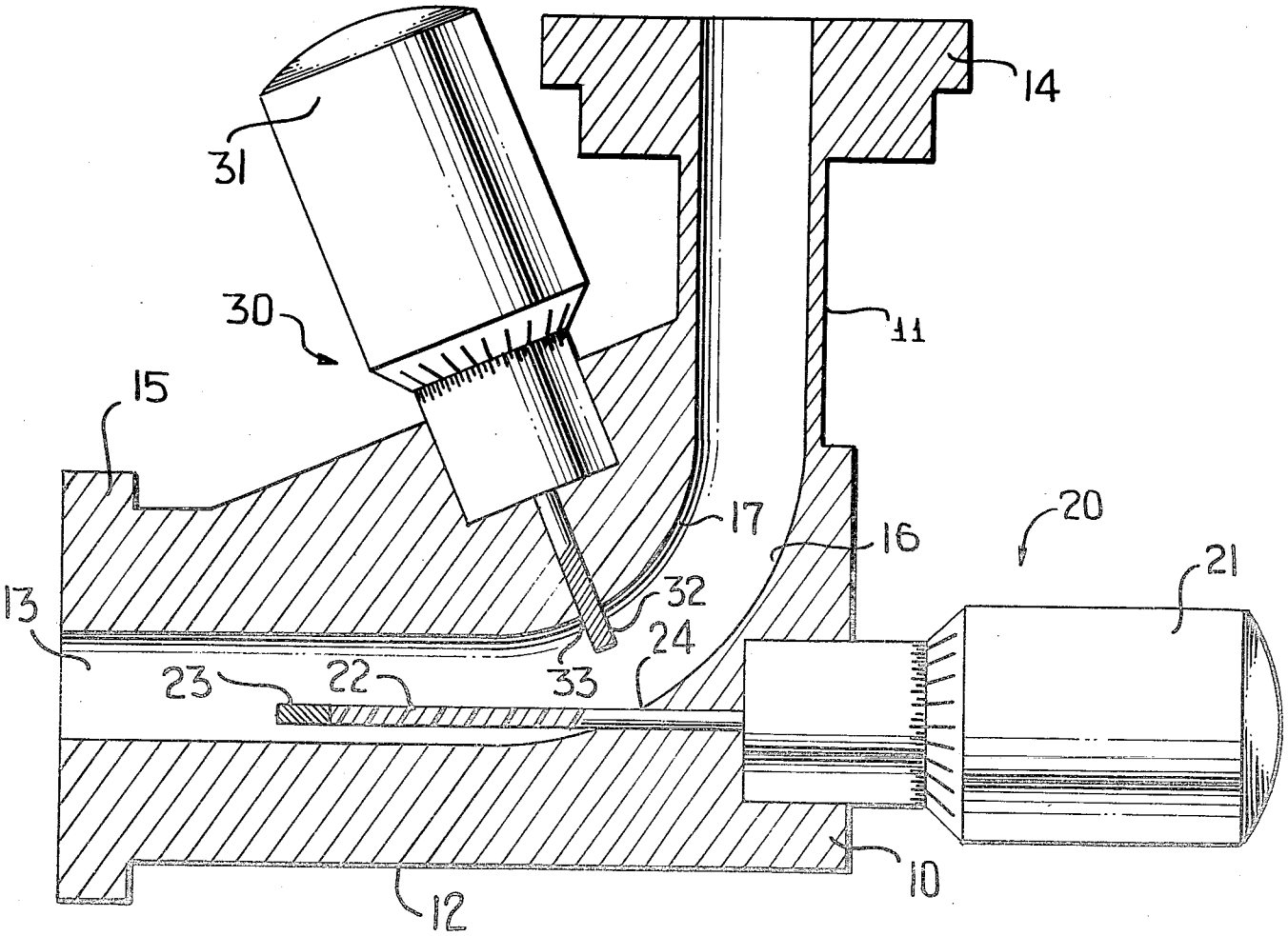
14
11
16
17
32
24
33
21
20
10
12
22
23
13
15
30
31

TWO STUB TUNER IN WAVEGUIDE BEND

TECHNICAL FIELD

The present invention relates to improvements in compensating for the effects of discontinuities in waveguides. More specifically, the present invention relates to a tuning apparatus and method for simply and efficiently cancelling unwanted reflected waves.

BACKGROUND ART

The connection of a component in a waveguide transmission system generally results in some degree of impedance discontinuity which causes undesirable reflected waves. It is well known in the prior art to attempt to tune out these reflected waves by means of a reflecting element which can be adjustably inserted into the waveguide. In cases where the tuning is required over a range of frequencies, more than one such reflecting element may be used. For example, a common technique is to utilize as many as five or more micrometer-driven stub tuners, spaced along the waveguide, to achieve tuning over a frequency range of 12.4 to 18 GHz. Tuning in this manner requires multiple operations, adjusting and readjusting each tuner, and even then complete cancellation of the reflected wave can rarely be obtained.

In U.S. Pat. No. 2,758,287 (Jacobson et al) there is described a single tuner which takes the form of a reflecting plate supported on a dielectric rod which is both rotatable and axially translatable in the waveguide. Translation of this tuner in a direction parallel to the axis of the waveguide results in changes in the phase of the reflected wave. Rotation of the reflecting plate about the translation axis results in changes in the reflected wave magnitude. In theory, the Jacobson et al approach provides a simple and effective way to achieve full cancellation of the reflected wave. However, in practice it is found that rotation of the rod without attendant translation, or translation with attendant rotation, is difficult to achieve. A similar device is disclosed in U.S. Pat. No. 3,518,580 (Hartman), this device also having the same practical limitation of not being able to keep the phase and magnitude adjustments independent of one another.

It is therefore an object of the present invention to provide a technique which permits simple effective and complete tuning in a waveguide transmission system for the purpose of cancelling out reflected waves. More specifically, it is an object of the present invention to provide a tuning arrangement which takes advantage of the simplicity affored by the aforesaid Jacobson et al and Hartman arrangements and yet which permits independent adjustment of the phase and magnitude of a cancelling wave.

DISCLOSURE OF THE INVENTION

In accordance with the present invention, a tuning arrangement employs two stub tuners which enter a waveguide bend from locations diametrically across from one another. A first tuner takes the form of a reflecting slug supported at the tip of a dielectric rod which is inserted from the outer wall of the waveguide bend and extends axially along the transmission path defined by one leg of the bend. The rod is movable axially to control the phase of the wave which it reflects, the reflecting slug being symmetrical with respect to the axis of the rod so that rotation of the rod does not affect the reflected wave magnitude. The second tuner is a metal rod or stub inserted transversely across the bend with its axis generally aligned with the access opening for the dielectric rod. Variable insertion of the metal stub into the bend controls the magnitude of the wave which it reflects. Both tuners are micrometer driven to permit accurate positioning and individual control.

BRIEF DESCRIPTION OF THE DRAWINGS

The above and still further objects, features and advantages of the present invention will become apparent upon consideration of the following detailed description of one specific embodiment thereof, especially when taken in conjunction with the accomanying drawings, wherein:

The single figure is a partial sectional view of the preferred embodiment of the present invention.

BEST MODE OF CARRYING OUT THE INVENTION

Referring specifically to the drawing, an elbow bend waveguide member 10 includes first and second perpendicular legs 11 and 12, respectively, within which the waveguide channel 13 bends 90°. It is to be understood that the 90° bend is by way of example only and that the principles of the present invention apply equally as well to bends of other angles. Legs 11 and 12 terminate in respective flanges 14 and 15 by means of which member 10 may be coupled to other waveguide sections or waveguide to coaxial adapters.

The tuner of the present invention includes two micrometer-controlled stub tuners 20 and 30 located at the bend of member 10. Stub tuner 20 includes a modified conventional micrometer 21 and tuning rod 22 positioned such that the rod is extended or retracted longitudinally within waveguide channel 13 in leg 12 as the micrometer 21 is rotated. In other words, rod 22 moves only parallel to leg 12 under the control of micrometer 21. Access of rod 22 into the waveguide channel 13 is provided by suitably disposed hole 24 in the outer channel wall 16 at the waveguide bend. Rod 22 is made of insulating or dielectric material and has a short metal stub 23 affixed thereto at its end remote from micrometer 21. The position of conductive stub 23 along leg 12 of the waveguide channel 13 is thus controlled by the degree of extension or retraction of rod 22.

Tuner 30 includes conventional micrometer 31 which controls the extension or retraction of a conductive stub 32. Tuner 30 is positioned such that stub 32 extends through a suitably provided hole 33 in the inner wall 17 of channel 13 across from hole 24 in the waveguide bend region. Stub 32 extends transversely across the waveguide channel at the bend to a length determined by the setting of micrometer 31.

the position of stub 23 in leg 12 determines the amount of phase compensation provided by the tuner arrangement. Stub 23 is entirely symmetrical so that incidental rotation of rod 22 does not affect the effective orientation of stub 23 within the waveguide channel. As a consequence, tuner 20 provides primarily phase tuning and has little variation in the magnitude of wave which it reflects. The degree of extension of stub 32 across the waveguide channel provides primarily magnitude tuning since it extends perpendicular to the channel. As a consequence, the tuner arrangement including tuners 20 and 30 provide nearly independent phase and magnitude controls. If desired, these can be adjusted simultaneously by an operator who would be watching a meter to determine when reflections are fully tuned out. Also, stub 32 can be fully withdrawn and then independent sequential control of phase and then magnitude compensation can be affected. Importantly, the combined tuners permit quick and accurate zero reflection compensation.

Micrometers 21 and 31 are modified conventional units and, by way of example, may be micrometer model 463 manufactured by the L. S. Starret Co., Athol, Massachusetts. Stub 32 is preferably brass but may be any conductive metal. Rod 22 may be any non conducting material and stub 23 is any conducting material, preferably brass.

Access holes 24 and 33 for the tuners may be located at other positions along the guide but are optimally located directly across from one another at the waveguide bend. There is a leeway on this spacing of plus or minus one-eighth wavelength at the highest frequency of the waveguide transmission. That is, an imaginary line extended transversely across the waveguide channel from hole 24 should meet hole 33 or be displaced therefrom by no more than one eighth ⅛ wavelength for optimum performance.

The length and diameter of stub 23 are selected to permit compensation of slightly more than the worst expected reflection condition.

While I have described and illustrated one specific embodiment of my invenion, it will be clear that variations of the details of construction which are specifically illustrated and described may be resorted to without departing from the true spirit and scope of the invention as defined in the appended claims.

I claim:

1. A waveguide tuner for permitting adjustment to cancel out undesired reflected energy waves in a waveguide transmission system, said tuner comprising:

a waveguide bend adapted to be inserted in said waveguide transmission system and having first and second legs subtending an angle other than 180° between one another;

phase tuning means including a dielectric rod having a metal slug at one end thereof, said rod extending along said first leg from a first location in said waveguide bend intermediate said first and second legs, and further including first control means for selectively translating said rod and slug longitudinally along said first leg; and magnitude tuning means including a metal stub extending transversely into said waveguide bend from a second location proximate said first location, and further comprising second control means for selectively varying the length of extension of said stub transversely into said waveguide bend.

2. The tuner according to claim 1 wherein said first and second control means are micrometer adjustments of the type in which rotation of a micrometer about an axis effects translation of a rod along that axis.

3. The tuner according to claims 1 or 2 wherein said first and second locations are disposed in opposite walls of said waveguide bend.

4. The tuner according to claim 3 wherein said first and second locations are longitudinally displaced along said waveguide bend between zero and one-eighth wavelength of the highest frequency of waveguide transmission.

5. The tuner according to claim 3 wherein said slug and said stub are made of brass.

6. The tuner according to claim 3 wherein said waveguide bend is 90°.

7. A method of tuning out reflections in a waveguide transmission system comprising the steps of:

adjusting the phase of said reflections by selectively translating a metal slug longitudinally along one leg of a waveguide bend from a first location intermediate the two legs of said waveguide bend; and adjusting the magnitude of said reflections by selectively extending a metal stub transversely into said waveguide bend from a location in said waveguide bend transversely cross from said first location.

8. The method according to claim 7 wherein said steps of adjusting the phase and magnitude are performed simultaneously.

9. The method according to claim 8 wherein said steps of adjusting the phase and magnitude are performed in the sequence stated.

* * * * *